United States Patent [19]

Neves et al.

[11] Patent Number: 4,590,823

[45] Date of Patent: May 27, 1986

[54] DUAL-STRING TUBING TONG AND METHOD

[75] Inventors: Billy W. Neves; Emery L. Eckel, both of Odessa, Tex.

[73] Assignee: Eckel Manufacturing Company, Inc., Odessa, Tex.

[21] Appl. No.: 658,822

[22] Filed: Oct. 9, 1984

[51] Int. Cl.[4] ..... B25B 21/00

[52] U.S. Cl. ..... 81/57.14; 81/57.15; 81/57.18; 81/57.19; 81/57.21; 81/57.3; 81/57.33

[58] Field of Search ..... 81/57.11–57.16, 81/57.18–57.21, 57.33, 57.34, 57.3

[56] References Cited

U.S. PATENT DOCUMENTS

| | | | |
|---|---|---|---|
| Re. 31,699 | 10/1984 | Eckel | 81/57.18 X |
| 3,703,111 | 11/1972 | Guier | 81/57.34 |
| 4,246,809 | 1/1981 | Keast et al. | 81/57.16 |
| 4,357,843 | 11/1982 | Peck et al. | 81/57.18 X |

FOREIGN PATENT DOCUMENTS

| | | | |
|---|---|---|---|
| 957918 | 11/1974 | Canada | 81/57.3 |
| 656738 | 8/1951 | United Kingdom . | |

*Primary Examiner*—Frederick R. Schmidt
*Assistant Examiner*—Debra S. Meislin
*Attorney, Agent, or Firm*—Norvell & Associates

[57] ABSTRACT

An improved power tong is provided of the type having a open throat portion for laterally moving the tong on and off a string of tubing. A ring member is rotatably guided by upper, lower, and intermediate bearings, and a cage plate assembly is partially disposed within the ring member. The rotatable cage plate is adapted for gripping engagement with a first string of tubing. An opening is provided between an outermost surface of the cage plate and ring assembly and an inner surface of a door for receiving a second string of tubing. According to the method of the invention, the first string of tubing is made up by rotating the ring member and cage plate assembly while the second string of tubing is housed within the body of the tong.

21 Claims, 6 Drawing Figures

DUAL-STRING TUBING TONG AND METHOD

FIELD OF THE INVENTION

The present invention relates to power tongs commonly used in oilfield operations for making up and breaking apart joints of tubing and, more particularly, relates to an open throat tong adapted for single-string or dual-string tubing operations.

BACKGROUND OF THE INVENTION

Tongs have long been used in oilfield operations to grip and rotate lengths of tubular members, thus "making up" or "breaking apart" joints of pipe. The tong performing the rotating operation or an upper pipe is generally referred to as the power tong, and the tong used to grip and prevent rotation of the lower pipe joint is generally referred to as a back-up tong. Back-up tongs may be either powered or manually operated, and their use is optional depending, in part, on the likelihood that the lower pipe would otherwise rotate in response to make up torque being transmitted to the upper pipe by the power tong.

Power tongs may be generally classified as either open throat or closed throat. Closed throat tongs generally have a circular ring member which fully encompasses the joint of pipe during the make up operation. An advantage of the closed throat or donut-type power tong is that the tong body and rotatable gear will not easily spread, and the tong is therefore capable of transmitting high torques to the pipe joint. Such tongs have a disadvantage, however, in that the tong cannot easily be laterally put on or taken off the string or pipe. In another version of a closed throat tong, a section of the gear is pivotable, so that lateral movement of the tong with respect to the drill string is possible. Such tongs are generally of the closed throat type, however, since the gear completely encompasses the joint of pipe during the make up operation. Examples of closed throat tongs are disclosed in U.S. Pat. Nos. 3,371,562, 3,483,774, 3,507,174, 3,550,485, 3,589,742, 3,635,105, and 4,334,444.

Many tong operators prefer an open throat tong, which is characterized by an open throat tong body portion with an optional latch door. Such tongs generally utilize a partial ring member having an open throat portion, so that the door may be opened and the throat of the tong body aligned with the throat of the partial ring. Open throat tongs thus have an operational advantage compared to closed throat tongs because the tongs may easily be laterally moved on and off a string of pipe. A disadvantage of the open throat design, however, is that such tongs may experience problems associated with "spreading" of the open throat portion, especially during high torque operations. Examples of open throat tongs are shown in U.S. Pat. Nos. 2,989,880, 3,021,739, 3,180,186, 3,196,717, 4,084,453, 4,170,907, and 4,346,629.

Most open throat tong bodies include a generally U-shaped front portion including the open throat adapted to receive the tubular member, and a rearward motor and gear train portion including a tail piece adapted for either a snub line or a back-up tong engaging bar. A snub line may be used to "tie off" the tong to prevent tong rotation while the joint of pipe is being made up. The engaging bar prevents axial rotation of the power tong by fixing the power tong body relative to the back-up tong, which is fixed to the lower string of pipe. Most power tongs are adapted for front entry, that is, the open throat portion of the tong is along the curvilinear portion of the U-shaped front portion and opposite the pair of drive gears with respect to the ring member centerline, as shown in U.S. Pat. No. 4,084,453.

A side-entry scissors-type tong is shown in U.K. Pat. No. 656,738. This tong includes a spinner, an upper tong body, and a lower tong body. The tong bodies rotate in scissors fashion relative to one another for accomplishing the final make up or the initial break out of the joint. A "angled entry" tong is shown in U.S. Pat. Nos. 2,846,909 and 2,950,639. These latter tongs are of the closed throat type since the gear completely encompasses the tubular member. The gear halves may be latched and unlatched by sets of vertically movable keys, and the gear halves may thus be opened to allow the tong to move on or off the pipe. An "angled-entry" open throat casing tong has also been manufactured and sold by Hillman-Kelley.

Each power tong is generally directed to a range of pipe diameters. Casing tongs handle casing in the range of $5\frac{1}{2}$ inches to 24 inches O.D.; drill pipe tongs are generally designed for $5\frac{1}{2}$ inchs to $11\frac{1}{4}$ inch O.D. pipe; tubing tongs frequently handle $2\frac{3}{8}$ inches to $7\frac{5}{8}$ inches O.D. tubing. Macaroni tubing ($3\frac{1}{2}$ inch O.D. and under) is typically used in recovery and hydraulic workover operations. In many operations, two or more strings of tubing are made up for placement within a casing, so that the strings of tubing are necessarily close together.

Most tongs are not particularly adapted for small diameter tubing. U.S. Pat. No. 4,246,809 discloses a power tong specifically designed for macaroni tubing, but this tong is of the closed throat type. Accordingly, the tong body cannot be laterally put on or taken off the pipe. The tubing must therefore pass through the tong as successive joints are made up, which may damage the tubing and/or the tong. Also, if a problem develops with the tong operation, the tong cannot be easily removed from the string of pipe.

Another tong capable of making up and breaking apart tubing is shown in U.S. Pat. Nos. 3,380,323 and 3,380,324, (hereinafter referred to as the Hillman-Kelley tubing tong), with an optional back-up tong shown in U.S. Pat. No. 3,387,512. The Hillman-Kelley tubing tong, however, experiences a number of problems in field operations because of its limited torque output and the frequency of repair due, in part, to the large number of moving components. Higher make up and break out torque capabilities for tubing tongs enable more varied use of the tongs and thus more efficient drilling operations. Tong operators also universally recognize that the cost associated with repair or replacement of a tong is nominal compared to the cost associated with stoppage of the drilling operation due to a tong breakdown.

A further problem associated with the Hillman-Kelley tong lies in its inability to be easily utilized to make up dual tubing strings, although the tong is widely utilized in dual string tubing operations. As previously stated, two or more tubing strings may be made up within a casing for production operations, so that a first tubing string is separated from a like tubing string by inches (generally the tubing centerlines are at 6 inch spacings). The design of the Hillman-Kelley tong is generally compact, so that one tubing string can be made up within the tong while a second tubing string is in engagement with the outer body of the tong. In many operations, however, the strings of tubing are so close together that the Hillman-Kelley tong can only be employed if the spacing between the two strings of pipe is increased. The Hillman-Kelley tong may be moved higher off the drilling rig floor, thereby allowing the flexing of the tubing strings to widen the spacing between the strings and thereby enable tong operation.

Although the above procedure has been widely utilized for years, it has a number of significant disadvantages. Additional operator time is required to spread the tubing apart above the rig floor, and this operation can bend tubing thereby making subsequent tubing handling more difficult. Also, the rig is not generally designed to have the tong positioned above the rig floor, so that make-shift operator platforms may be utilized or the tong operated without the operator being able to properly view the make up operation. Thus, an unsafe working environment may be created, and the tong may not be reliably utilized to efficiently make up or break apart dual strings of tubing.

The disadvantages of the prior art are overcome by the present invention, and an improved power tong is hereafter disclosed for making up and breaking apart joints of tubing. An improved method is also disclosed for making up dual string joints of tubing utilizing the power tong of the present invention.

SUMMARY OF THE INVENTION

A power tong is provided of the type having an open throat body, a rotatable ring member having an open throat portion, and a cage plate assembly having an open throat portion and rotatable with respect to both the ring member and the tong body. A door may be provided for closing across the open throat portion of the tong. Power is transmitted through a drive train to rotate the ring member, bringing dies into gripping engagement with the tubing. Thereafter, the ring member and cage plate assembly rotate in unison to make up the joint of tubing.

A ring member has a relatively small diameter, although the tong is designed for high make up and break out torques. The ring member is rotatably guided by pluralities of upper, lower, and intermediate bearings, which also provide structural support for the ring member. The innermost diameters of the cage plate assembly and ring member may be approximately equal, and the outermost diameter of the composite cage plate and ring assembly is minimized to approximately 8 inches while still providing sufficient structural strength to minimize spreading of the ring member. The cage plate assembly is partially disposed within the ring member, and carries a plurality of radially slidable heads having gripping dies.

The open throat of the tong may conveniently be provided on the side of the tong, and the tong may either be easily tied off to a stationary portion of the rig or rotatably fixed by engagement with a back-up tong. The side-throat feature of the tong enables the tong to be conveniently positioned on the rig, and the tong may be put on and taken off each of the dual strings of tubing without rotating the tong to a new position.

An opening is provided between the outermost surface of the cage plate and ring member assembly and an inner surface of the tong door. This opening is sized for receiving a second string of tubing, so that the tong may be utilized to make up a first string of tubing while the second string of tubing is within the tong body. In an embodiment of the tong without a door, the second string of tubing is positioned within the open throat portion of the tong.

Accordingly, it is a feature of the invention to provide a power tong particularly suitable for making up and breaking apart single-string or dual-string tubing. When utilized with dual-string tubing, a first string of tubing is positioned within the cage plate and ring assembly, while a second string of tubing is provided within the open throat of the tong and spaced interiorly of the tong body. Spreading of the tubing to facilitate tong operation may therefore not be required, and the tong may be operated at a normal height with respect to the rig floor.

The tong may also be provided with a drive means capable of operating in one of three selected speed/-torque ranges, and the tong may be easily shifted from one speed to another speed by operating a minimum number of controls. The tong may be provided with a latchable door to minimize spreading of the open throat portion of the tong, or a simple safety-type door may be provided and the walls of the tong designed sufficiently thick to minimize spreading.

These and other features and advantages of the present invention will become apparent from the foregoing description, wherein reference is made to the Figures in the accompanying drawings.

DESCRIPTION OF THE PREFERRED EMBODIMENTS

Figure 1:
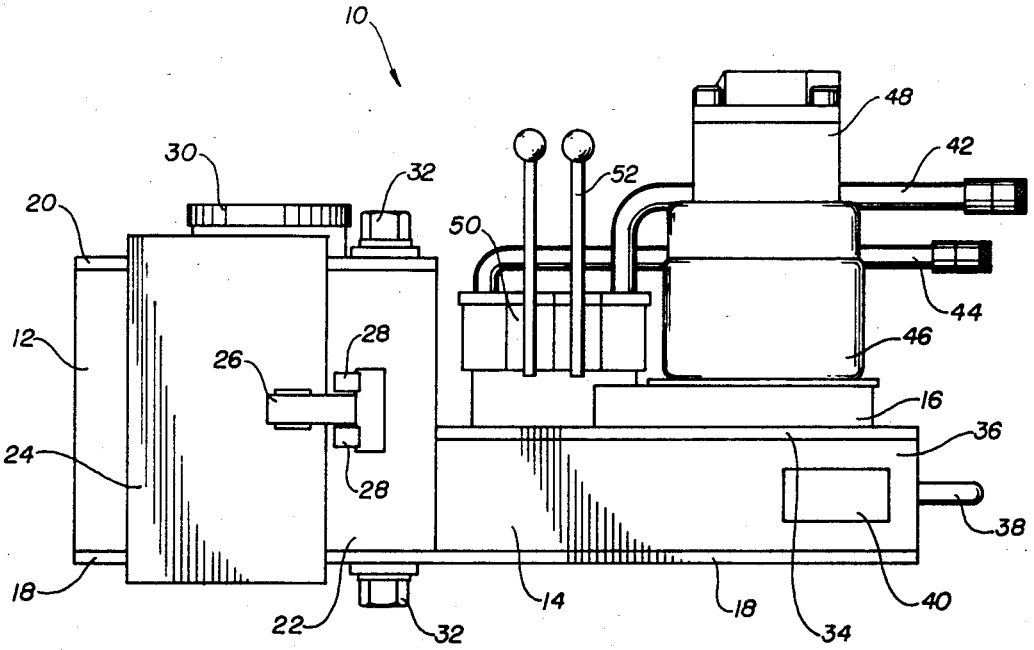
FIG. 1 is a side view of the power tong according to the present invention.

FIG. 1 depicts a power tong for making up and breaking apart tubular members, such as tubing commonly used in oilfield operations. The tong 10 comprises a front body portion 12 and a rearward drive train body portion 14. The front body portion 12 includes a lower body plate 18 and an upper body plate 20. The rearward body portion 14 includes an upper body plate 20, while plate 18 is continuous to form the lower body plate for both the front and rearward body portions.

The tong 10 is of the open throat type, so that the tong body may be laterally put on and taken off by a string of pipe. The front portion of the tong includes a generally U-shaped sidewall 22 between plates 18 and 20. A door 24 with a latch mechanism 26 is pivotally mounted to the tong body for latchable engagement with dogs 28 affixed to the sidewall 22. The door is thus positioned over the open throat portion of the tong, and it should be understood that the door may be provided in either side of the U-shaped sidewall relative to the centerline of the tong body. FIG. 1 also depicts the upper portion of the rotatable cage plate 30 and shaft bearing nuts 32.

The rearward drive train body portion 14 includes a generally U-shaped sidewall 36, a tong "tie off" handle 38, and an access door 40. Pressurized hydraulic fluid is input via line 42 and returned via line 44 to a suitable power unit (not depicted), such as a diesel-powered skid-mounted hydraulic unit. Pressurized fluid is transmitted through valve block assembly 50 to power either or both a medium speed/medium torque motor 46 and a high speed/low torque motor 48. Motors 46 and 48 are mounted on base 16 for driving gearing (depicted in FIG. 2) within the drive train body portion 14.

Hydraulic motors 46 and 48 are each vane-type tandem hydraulic fluid motors. Although manufactured as a single unit, a tandem motor structurally and functionally may be understood as both a medium speed hydraulic motor 46 and a high speed hydraulic motor 48 mechanically connected by a common drive shaft so that the motors rotate in unison. Valve block 50 may be actuated by one or more control handles 52 for controlling the passage of fluid to each of the motors 46 and 48. Operation of the control handles 52 causes the tandem motor to rotate in one of three selected speed/torque ranges and in either the forward or reverse direction. Suitable tandem fluid motors are described in an Abex/-Denison Service Literature Brochure SFM-M4DC (Rev. A), and suitable valve blocks are described in a brochure entitled "A 20/35 Direction Control Valves" by Commercial Shearing, Inc. Further details regarding the tandem motors and valve blocks are disclosed in co-pending allowed Patent Application Ser. No. 624,146, which is hereby incorporated by reference.

Figure 2:
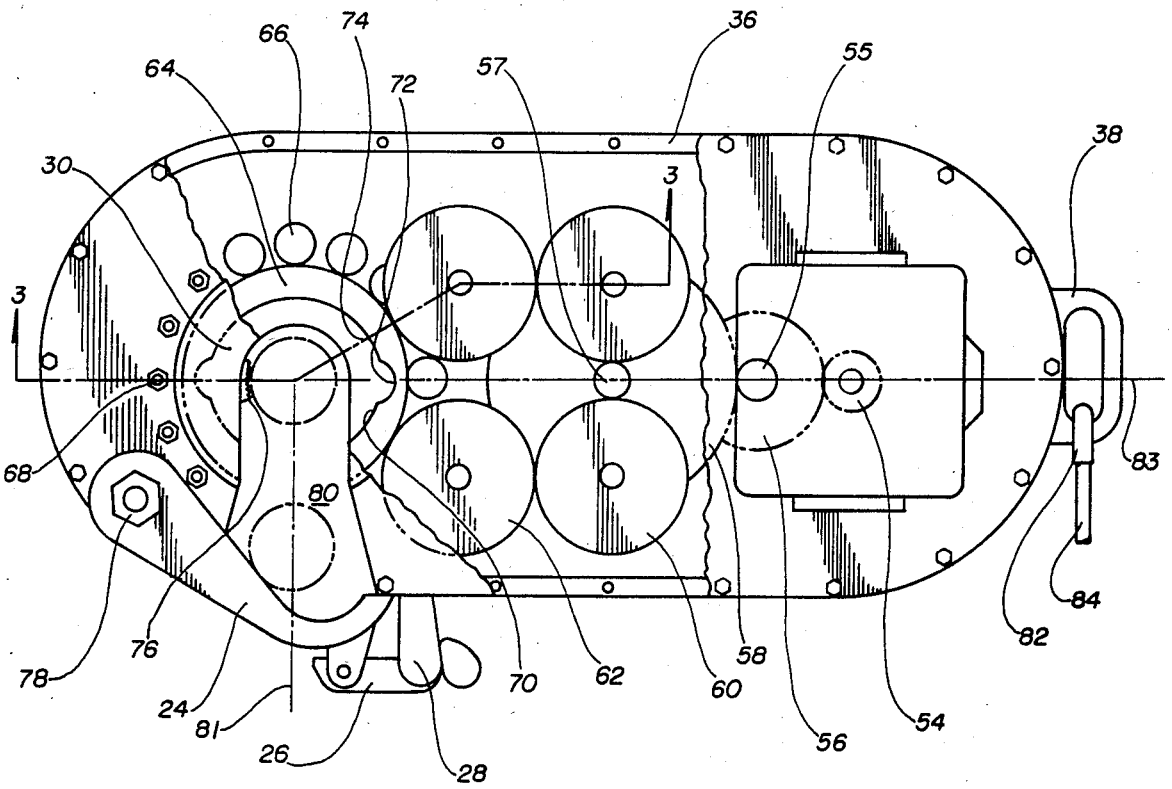
FIG. 2 is a top view, partially in cross-section, of the power tong depicted in FIG. 1.

FIG. 2 depicts a top view, partially in cross-section, of the tubing tongs shown in FIG. 1. It should be understood that the tandem motor drives pinion gear 54, which meshes with gear 56. Gears 55 and 56 are mounted on a common shaft, so that rotation of gear 55 rotates gear 58, which is mounted on a common shaft with gear 57. Gear 57 rotates two gears 60, which mesh with spaced-apart drive gears 62. As explained further below, simultaneous rotation of drive gears 62 rotates the ring member 64, thereby rotating or "making up" the pipe.

The ring member 64 includes an open throat portion for alignment with the open throat portion of the tong body so that the tong may be laterally put on and taken off the pipe. The drive gears 62 are spaced so that at least one drive gear is in engagement with the ring member as the open throat portion of the ring rotates past the drive gears. The ring member is rotatably guided by a plurality of roller bearing assemblies 66 secured to the upper and lower tong body plates by nuts 68. The partial ring member 64 includes camming surfaces 70 and 74, and a neutral cam surface 72. The design of a preferred ring member 64 and further details regarding typical tong gearing are described in U.S. Pat. No. 4,084,453, which is hereby incorporated by reference.

The cage plate assembly 30 is rotatable with respect to both the ring member 64 and the tong body, and also includes an open throat portion which may be aligned with the open throat portions of both the ring member and the tong body for receiving a pipe. The cage plate assembly 30 carries a plurality of heads (preferably two) 76, which are slidably mounted within the cage plate assembly and radially movable toward the pipe for gripping engagement with the pipe. It should therefore be understood that the drive means 46, 48 of the tong acts to rotate the gearing in the rearward tong portion 14, thereby rotating the ring member 64 in any one of three selected speed/torque ranges and either the forward or reverse direction. Rotation of the ring member 64 relative to the cage plate assembly 30 causes the heads 76 to come into gripping engagement with the pipe due to the action of the cam surfaces 70 and 74. Thereafter, the ring member 64 and the cage plate 30 may be driven in unison to rotate or "make up" an upper pipe relative to a lower pipe.

FIG. 2 also depicts a tong body centerline 83, which may be defined as a line passing through the axis of the ring member 64 and equidistant between the centerlines of the speed drive gears 62. If the tong is chain driven, two spaced sprockets will generally be provided for guiding the chain along a portion of the ring member, and the centerline of the tong would thus pass equidistant between the centerlines of the sprockets which replaced the direct drive gears. In a front-throat tong, the open throat portion of the tong is generally provided along the tong centerline, while according to the present invention, the tong open throat portion may be provided on either side of the tong spaced from centerline 83. FIG. 2 also depicts a handle 38 secured to the tail end of the tong body. A cable 84 or rigid bar may be attached to the handle 38 at 82, and may be secured at the other end to a fixed rig structure to "tie off" the tong in a manner described subsequently.

Door 24 is pivotably mounted to the tong body at 78, and includes a standard latch mechanism 26 for latchable engagement with the pair of dogs 28 secured to the sidewall 22. As shown in FIG. 2, with the door 28 latched in the closed position for minimizing spreading of the open throat portion, a first pipe is axially aligned with the centerline of the cage plate assembly 64 and the ring member 30, while a second pipe is positioned in opening 80 spaced interiorly of the latched door. The open throat portion of the tong may be provided on either side of the tong according to the present invention so that the open throat is radially spaced from the tong body centerline 83. The open throat centerline 81 as shown in FIG. 2 is preferably substantially perpendicular to the tong body centerline 83.

Figure 3:
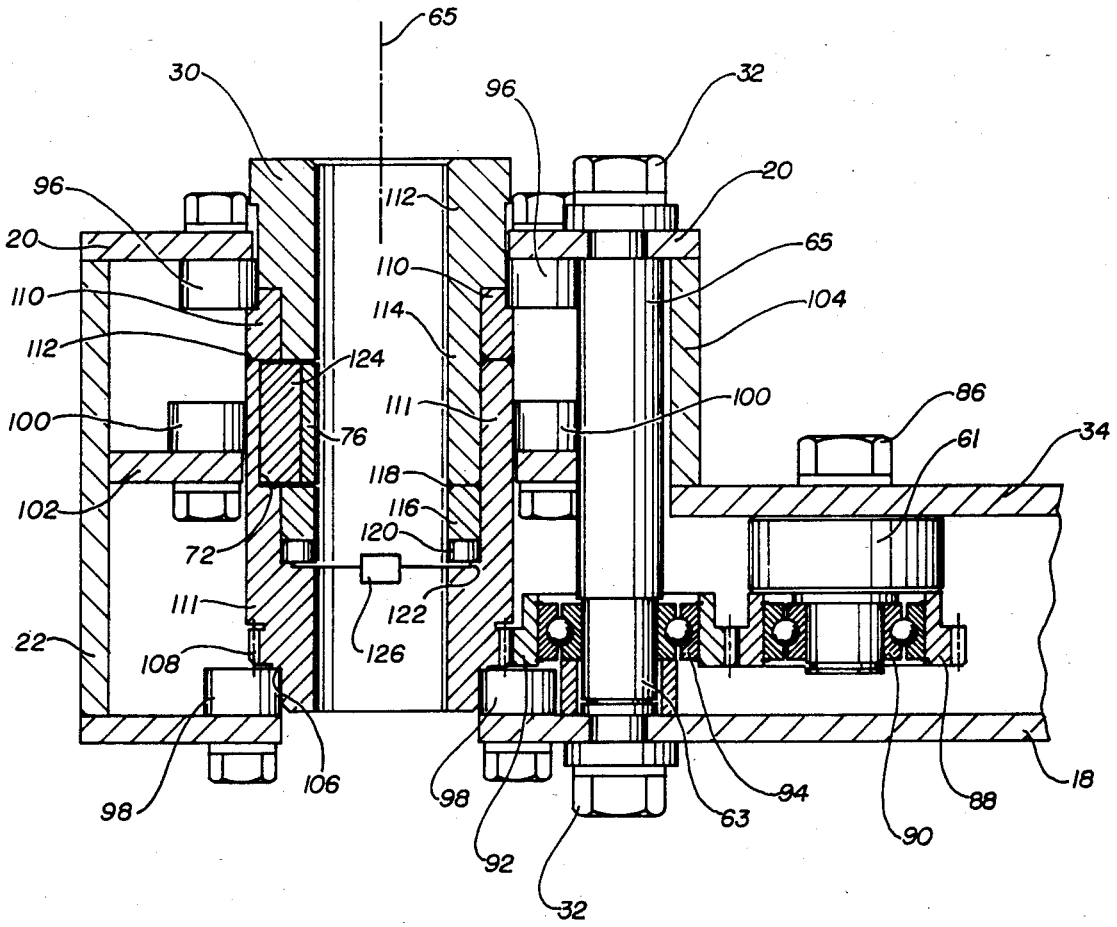
FIG. 3 is a vertical view, partially in cross-section, taken along line 3—3 in FIG. 2.

Referring now to FIG. 3, a side view, partially in cross-section, of a portion of the apparatus depicted in FIG. 2 is shown. It may be seen that the front portion of the tong including upper body plate 20, lower body plate 18, and U-shaped sidewall 22 is separated from the rearward drive train portion of the tong body by a vertical wall 104. The cage plate assembly 30 is thus provided within the higher front portion of the tong body, while the lower rear body portion of the tong houses a portion of the drive train.

One of the gears 60 shown generally in FIG. 2 is depicted in FIG. 3, and includes gear member 88 and bearing subassembly 90 rotatably mounted on a shaft 61 secured to the top plate 34 by nut 86. The shaft 61 is provided with a large diameter portion to act as a spacer for properly spacing the gear member 88. Each of the gears within the rearward drive train section of the tong may be similarly supported, and such drive train systems are well known in the art and shown for example, in U.S. Pat. No. 4,034,453.

Spaced gears 62 each mesh with one of the gears 60, include a gear member 92 and bearing 94 rotatably mounted on a shaft 63. Shaft 63 is provided in the front section of the tong body, and includes elongated shaft portion 65. Each shaft 63 provides additional structural support for the front section of the tong, and is rotatably mounted with suitable collars between the upper plate 20 and the lower plate 18 by nut 32.

The ring member 64 is shown in cross-section in FIG. 3, and teeth 108 of the ring member mesh with corresponding teeth in each of the pair of drive gears 62. The upper body ring portion 110 and the lower body ring portion 111 may be joined by a suitable weld 112. The ring member may be manufactured as a single unit, or manufactured in two sections to facilitate the forming of the cam surfaces, then joined together as shown in FIG. 2.

The neutral cam surface 72 depicted in FIG. 2 is shown in cross-section in FIG. 3. A head including a conventional head roller may be provided for engagement with the cam surfaces. Alternatively, the head 124 shown in FIG. 3 is provided with an integral rear arcuate surface for sliding engagement with the cam surfaces. The rear arcuate surface thus functionally replaces the head roller, and the strength of the head is thereby increased. The radially inward dies 76 on the head are disposed for gripping engagement with the pipe upon rotation of the ring member relative to the cage plate assembly. Such rotation causes the arcuate surface on the head to move up the cam surfaces 70, 74 until the dies 76 come into gripping engagement with the pipe, and thereafter the cage plate assembly and the ring member may rotate in unison with the pipe. The heads are thus slidably movable within the cage plate assembly in a radial direction relative to the centerline or axis 65 of the ring member. Although radially movable sliding heads are preferable according to the present invention because of the compact design of the cage plate and ring member, heads pivotable with respect to the cage plate could also be employed. Further details regarding sliding heads are disclosed in U.S. Pat. Nos. 3,380,323 and 3,380,324, and further details regarding pivotable heads in the cage plate assembly are disclosed in U.S. Pat. No. 4,084,453, each hereby incorporated by reference.

The ring member 64 is rotatably guided and structurally supported by a plurality of upper rollers 96 mounted to the top plate 20, a plurality of lower rollers 98 mounted to the bottom plate 18, and a plurality of intermediate rollers 100 mounted to intermediate plate 102. A suitable number of upper rollers, lower rollers, and intermediate rollers may be provided, with each roller generally mounted about the ring member in a position as shown by rollers 66 or mounting nuts 68 in FIG. 2.

A plurality of bottom rollers 98 provide axially-directed support for the ring member. The ring member is provided with an annular ledge 106, so that the weight of the ring member is distributed to the plurality of lower rollers 98, but the axially-directed force is applied to only a portion of each roller. This technique reduces the area of the ring member in axial engagement with each of the rollers 98, and contributes to rolling engagement rather than sliding engagement between the rollers 98 and the ring member thereby increasing the life of the rollers.

The intermediate rollers 100 are mounted on intermediate plate 102, which may conform in configuration to the top plate 20. The thickness of the intermediate plate 102 may be easily varied, e.g., $\frac{1}{4}$ inch to $1\frac{1}{4}$ inch, to minimize spreading of the open throat portion of the tong. A plurality of intermediate rollers 100 are preferably spaced axially with respect to the axis of the ring member for engagement with that portion of the ring member containing the cam surfaces 70, 72, and 74. In other words, the intermediate rollers 100 are positioned about the ring member at the same vertical elevation as the cam surfaces, so that the cam surfaces and the rollers 100 are in the same horizontal plane, as shown in FIG. 3. The ring member is relatively thin in the area of the neutral cam surface, and intermediate rollers 100 thus provide additional structural support to the ring member in this region.

The upper plurality of rollers 96 are in rolling engagement with both the upper body portion 110 of the ring member 64 and an outer surface of the cage plate assembly 30. The cage plate assembly 30 is also rotatably guided by a plurality of rollers 120 secured to the lower end of the cage plate assembly and in rolling engagement with an inner surface of the ring member. Alternatively, one set of upper rollers could be provided for engagement with an upper portion of the ring member, and another set of rollers provided for engagement with the upper portion of the cage plate assembly. The cage plate assembly 30 may also be of unitary construction, or may be fabricated in two sections 114 and 116 to facilitate the formation of the openings for the heads, and then joined by welds 118. An annular ledge 122 may be provided on the ring member, so that the weight of the cage plate assembly is distributed to only a portion of each of the rollers 122. FIG. 3 also depicts a backing lug 126 affixed to the ring member and the function of such a backing lug and a backing lug pin (not depicted) is well known in the art.

Referring to FIGS. 2 and 3, it may be seen that the tong may be activated to rotate one tubular member while another tubular member is positioned within the tong body and interiorly of the closed door. The opening 80 in the throat of tong body is sized so that the diameter of the tubing in the opening 80 is less than the spacing between the outermost surface of the combined rotating ring member and cage plate assembly and the inner surface of the tong door. If desired, a suitable stop member (see member 79 in FIG. 5) may be mounted to the tong body to be selectively positioned to prevent the tubular member in the opening 80 from being bumped into engagement with the outermost surface of the ring member and cage plate assembly as those components are rotated by the drive means.

The diameter of the outermost surface of the rotating ring member and cage plate assembly is therefore minimized to provide sufficient spacing within the tong body (with the door closed) for accommodating a second tubular member. Tubing is frequently provided within a casing on centerline spacings of approximately 6 inches. The outer surface of the rotating ring member and cage plate assembly is preferably restricted according to the present invention to a diameter of less than approximately 9 inches, and preferably in the range of from 8.25 to 7.5 inches. If the outermost surface of the composite cage plate and ring member is maintained at less than 8.25 inches, the tong is able to make up and break apart $3\frac{1}{2}$ O.D. dual-string tubing without spreading the tubing apart from its 6 inch centerline spacing as normally maintained in the slips. In the tong as shown in FIGS. 1–3, the outermost surface of the composite ring member and cage plate assembly has a diameter of approximately 8.0 inches.

The inner diameter of the lower portion of the ring member approximates the inner diameter of the cage plate assembly so as to provide additional structural support to the ring member. A portion of the cage plate assembly 30 is rotatably positioned radially within the ring member, although a top portion of the cage plate assembly is positioned axially above the ring member. This top portion of the cage plate assembly has an outer diameter approximating the outer diameter of the cage plate assembly to provide additional structural support to the cage pipe assembly. Thus, both the I.D. and the O.D. of the cage plate assembly and the ring member are preferably approximately equal, so that the strength of each member is sufficient to withstand high torques without serious spreading of their respective open throat portions. The entire cage plate assembly 30 may be easily inserted within and removed from the tong without disassembling other components. The cage plate assembly 30 does not extend from above to below the ring member in an axial direction, and the lowermost portion of the cage plate assembly terminates in an axial direction within the body of the ring member.

Figure 4A:
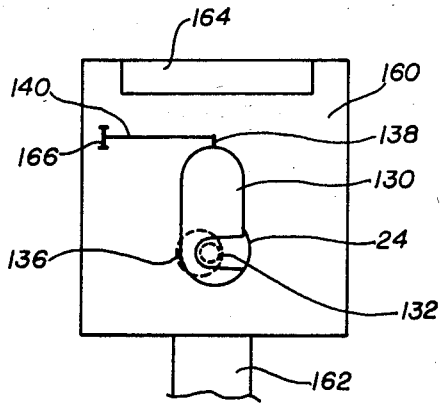
FIGS. 4A and 4B are highly simplified top views of a power tong on a simplified rig floor.
Figure 4B:
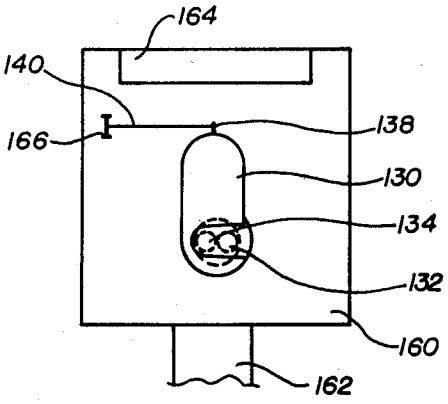

Referring to FIGS. 2, 4A, and 4B, the operation of the tong will be described. The simplified rig 160 shown in FIGS. 4A and 4B includes a V-door 162 and drawworks 164 opposite the V-door. Tong 130 may be generally positioned on the rig floor with its tail end toward the drawworks, the door 24 of the tong opened, and the axis of the tong ring member aligned with tubing 132 within the casing 136. A suitable cable or rigid bar member 140 may be secured at one end to the handle 38 of the tong body and attached at the other end to a fixed member 166 of the drilling rig structure. The tong is thereby "tied off", so that subsequent activation of the tong will not cause rotation of the tong body. The side of the tong 130 with the open throat and the desired direction of rotation (either make up or break out) thus determine where the tong will be tied off if a cable is employed. If a rigid bar is used to "tie off" the tong, the bar may remain in place for both the make up and the break out operation. If a back-up tong is employed with the power tong described herein, a downwardly extending back-up tong engaging bar may be utilized to fix the rotation of the tong body relative to the back-up tong. Generally, however, the tong will still be tied off as described above, for safety reasons. Further details and advantages of such a back-up tong engaging bar are disclosed in U.S. Pat. No. 4,402,239, hereby incorporated by reference.

With the tong properly aligned with the tubing 132, the door 24 may be closed and latched to minimize spreading of the open throat portion of the tong. The tong may be activated at a selected speed/torque range to cause the dies 76 to come into gripping engagement with the tubing. Further rotation of the ring member causes the upper tubular member gripped by the cage plate assembly to rotate and be made up relative to the stationary lower tubular member. When the make up operation is complete, the door may be opened and the tong laterally moved away from the made up tubing 132.

A new section of tubing 134 may be generally aligned with a second tubing string and, with the tong tied off at 140, the door 24 may be closed and latched. The tubing 132 is positioned within the opening 80 and spaced interiorly of the closed door, as shown in FIG. 2. The tong may again be activated, making up the tubing joint for 134. When the operation is complete, the door 24 may be opened and the tong laterally moved off both strings of tubing 132 and 134. It should be understood that the length of the tie off member 140 need not be changed between making up tubing strings 132 and 134. The tail end of the tong may remain in a fixed position relative to member 166 and the tong body pivoted about its tail end for aligning the ring member with either of the strings 132 or 134.

For the break out operation, the procedure is substantially similar. A tong may first be positioned with the tong ring member aligned with the tubing 134, and the tubing 132 spaced within the tong body and interiorly of the closed door 24. After the joint of tubing 134 has been broken out, the door 24 need not be opened and the tong may simply be moved so that the ring member is axially aligned with the tubing 132. The coupling for the tubing string 134 would generally remain with the back-up tong, so that the tong of the present invention may easily be moved so that the ring member is aligned with the tubing 132, i.e., the bottom of the tubing tong is slightly above the coupling for the tubing 134. Also, the coupling for the tubing string 134 may be slightly lower than the coupling for the tubing string 136. Alternatively, the tong may be raised slightly so that the lower joint of the string 134 does not interfere with the proper placement of the tong for breaking out the joint 132.

An automatic door latching mechanism which may be used in conjunction with the tong of the present invention. A door may be pivotally connected to the body of the tong, and when properly aligned, the door acts to prevent "spreading" of the tong in the area of the open throat under high make up or break out torques. Many tong operators prefer that the door be manually opened and closed, since the operator is generally in the vicinity of the tong door when being placed on or taken off a pipe, and since a powered door closure may be a safety hazard. Also, allowing for manual closure of the door allows an operator to operate the door at low torque when the door is open, and thus the operator need only close the door when high torque is required. If a powered door closure is desired, a hydraulic cylinder (not depicted) may be provided between the tong body and the door. Suitable cylinder-type door closure devices are more fully described in U.S. Pat. Nos. 4,084,453 and 4,334,444, which are hereby incorporated by reference.

The automatic door lock device of the present invention includes a pin rotatably mounted to the tong body in a position for latching the door in the closed position by engagement with a block secured to the door. The pin may be connected to an adjacent hydraulic motor by gearing, so that activation of the motor acts to latch or lock the door in the closed position and unlatch the door so that the door may subsequently may be opened to move the tong laterally on or off the tubing.

The pin may include recessed surfaces, so that the pin may be rotated 90° so that a slot portion of the block may receive the pin. Thereafter, the pin may be rotated so that a curved outer surface of the pin enages the inner surface of the slot. The distance between the pins is thus fixed by the rigid door, so that substantial "spreading" of the open throat of the tong cannot occur.

Further details regarding the automatic door closure device according to the present invention are disclosed in allowed U.S. patent application Ser. No. 624,146, which is hereby incorporated by reference. It should also be understood that the present invention contemplates the use of a manually-operated door closure device. Such manually-operated door closure devices are customary in the prior art for minimizing spreading of the open throat portion of the tong, and may utilize a handle connected to the pin for manually rotating the pin.

Figure 5:
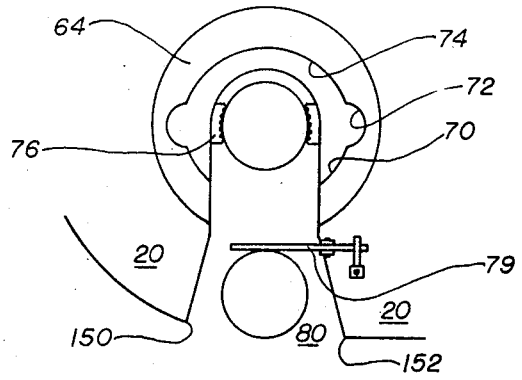
FIG. 5 is a top view of a portion of an alternate embodiment of the tong depicted in FIGS. 1–3.

FIG. 5 depicts an alternate embodiment of the present invention, wherein the tong is provided without a door for closing over the open throat portion of the tong. Use of such a door is preferably for safety reasons even if the door is not provided with a latch mechanism for minimizing spreading, so that a person or object cannot move laterally into the rotating ring or cage plate assembly through the open throat portion of the tong. Accordingly, a door 24 may be provided according to the present invention without a latch mechanism as described above for minimizing spreading of the open throat portion of the tong, or with a latch mechanism for securing the door in a closed position but which does not prevent spreading. A door with a latch mechanism as shown in FIG. 2 is, however, preferred.

FIG. 5 depicts a portion of an alternate embodiment of the tubing tong according to the present invention. The ring member 64 is axially aligned with a first tubular member, and dies 76 carried by the cage plate assembly are in gripping engagement with the tubular member. According to the method of the present invention, an opening 80 is provided in the open throat portion of the tong sufficient to accommodate the positioning of a second tubular member at least partially within the open throat portion of the tong. The term "open throat portion" of the tong as used herein may be defined as the open area between the tong body and the aligned ring member and cage plate assembly, and extending outward from the axis of the ring member to a line interconnecting two points on the tong body contiguous with the open throat portion of the tong and furthest from the axis of the ring member. As shown in FIG. 5, those two points are indicated by the points 150 and 152. According to the method of the present invention, at least a portion of the second tubular member is positioned within the open throat portion of the tong while a first tubular member is being made up by the rotating ring member 64. Preferably, the second tubular member is positioned in the opening 80 so that the centerline of the tubular member is also within the open throat portion of the tong.

FIG. 5 also depicts a stop member assembly 79 pivotally mounted to the tong body for prohibiting the second tubing string from inadvertently engaging the outermost surface of the rotating cage plate and ring assembly holding the first tubing string. A portion of the stop member may be rotated for crossing a sufficient portion of the throat 80 to prevent such inadvertent movement of the second tubing string into the cage plate and ring member assembly. In the position as shown in FIG. 5, a stop member is secured in the "stop" position by a toggle-type latch. Movement of the latch to the release position allows the stop member to pivot downwardly to a substantially vertical position so as not to block the throat 80. Alternatively, a hydraulically-responsive cylinder and stop arm may be provided for serving as a stop member, so that the arm would be automatically brought into the stop position upon activation of the tong for rotating the ring member, and automatically return to the "clear" position upon deactivation of the tong. Although such a stop is not believed to be necessary for the tong as shown in FIG. 1, either of the above stop means could also be provided with a tong having a door as shown in FIG. 1.

The tubing tong plates of the tong according to the present invention preferably protrude radially outwardly from the outermost surface of the composite cage plate and ring assembly so that the secured tubular member is positioned within the open throat portion of the tong. Compared to the design of the Hillman-Kelley tubing tongs, wherein the tong body plates terminate substantially adjacent the outermost surface of the ring member, the design of the present invention enables the tong to withstand higher make up and break out torques because of the increased strength provided by the protruding tong body plates. Also, the side-entry open throat design of the tong according to the present invention allows the additional tubing string to be located within the tong body during break out of the first tubing string, so that the additional tubing string does not interfere with the placement of operation of the tong.

Tubing tongs according to the present invention are capable of making up and breaking apart dual strings of tubing located on 6 inch centerlines. Each of the dual string tubings commonly used in petroleum operations has a maximum outer diameter of 3.5 inches and a minimum outer diameter of 0.75 inches. Tubing diameters in dual string tubing operations are commonly equal, and in the range of from 2.06 to 3.50 O.D. Heads are thus provided for each particular tubing diameter, so that the user of the tong would change heads between using the tong on 3.5 O.D. tubing and using the tong on 2.38 O.D. tubing. The tong of the present invention is thus designed with an area within the open throat portion of the tong in functional relationship for receiving a preselected range of tubing diameters.

It should be understood that the terms high speed, medium speed, low speed, low torque, medium torque, and high torque with respect to the tandem access motor described herein are each relative terms. As such, a medium speed/medium torque motor is defined as any motor having a lower speed and a higher torque than a high speed/low torque motor. A low speed/high torque motor is defined as any motor having a lower speed in a higher torque than a medium speed/medium torque motor.

Numerous modifications from the illustrative embodiments disclosed herein may be made without departing from the spirit or scope of the invention. In particular, it should be understood that the arrangement of the tong body with respect to the drilling rig as shown in FIGS. 4A and 4B is exemplary, and in some situations it may be desirable or necessary to rotate the tong body from one position to another before making up or breaking apart dual tubing strings. These and other modifications of the invention will be apparent to those skilled in the art and are intended to be within the scope of the present invention.

What is claimed is:

1. A power tong for making up and breaking apart first and second strings of tubing each having an outside diameter of from 3.5 inches to 0.75 inches and vertically positioned for a drilling operation, comprising:

a tong body having a first open throat portion for receiving said first and second strings of tubing;

a door pivotable about said tong body for opening to receive said strings of tubing and for closing across said first open throat portion;

a ring member including one or more camming surfaces rotatably mounted within said tong body and having a second open throat portion for alignment with said first open throat portion;

a cage plate assembly rotatably mounted at least partially within said tong body and having a third open throat portion for alignment with said first and second open throat portions;

drive means for rotating said ring member;

a plurality of heads carried by said cage plate assembly for being forced by engagement with said camming surfaces into gripping engagement with said first string of tubing upon rotation of said ring member relative to said cage plate assembly;

an outermost surface of said rotatable ring member and cage plate assembly and an inner surface of said door when closed across said first open throat portion defining an opening therebetween within said first open throat portion for receiving said second string of tubing while said ring member and cage plate assembly are rotating for making up or breaking apart said first string of tubing; and stop means supported by said tong body and positionable within said first open throat portion for prohibiting said second string of tubing from engaging said outermost surface of said rotatable ring member and cage plate assembly.

2. A power tong as defined in claim 1, further comprising:

a pair of drive gears each driven by said drive means and for cooperation with said ring member;

a tong body centerline defined by a line passing through an axis of rotation of said ring member and equidistant between said pair of drive gears; and said first open throat portion being spaced radially from said tong body centerline.

3. A power tong as defined in claim 2, further comprising:

said tong body including a drive train body portion spaced substantially opposite said cage plate assembly with respect to said pair of drive gears, said drive train body portion housing portions of said drive means;

tong securing means attached to said drive train body portion for prohibiting substantial rotation of said tong body; and said first open throat portion having an open throat centerline substantially perpendicular to said tong body centerline.

4. A power tong as defined in claim 1, wherein said outermost surface of said rotatable ring member and cage plate assembly has a diameter of between approximately 7.5 inches and 9.0 inches.

5. A power tong as defined in claim 4, wherein said ring member is rotatably guided within said tong body by a plurality of upper, a plurality of lower, and a plurality of intermediate roller supports mounted to said tong body.

6. A power tong as defined in claim 5, wherein said cage plate assembly includes guide means for limiting movement of said heads in a substantially linear direction; and said guide means controls movement of each of said plurality of heads within said cage plate assembly in a radial direction with respect to the axis of said ring member for gripping engagement with said first string of said tubing.

7. A lower tong as defined in claim 1, said drive means further comprising:

a high speed/low torque motor responsive to pressurized fluid for rotating said ring member;

a medium speed/medium torque motor responsive to pressurized fluid for rotating said ring member;

said high speed/low torque motor and said medium speed/medium torque motor being mechanically connected in tandem such that said motors rotate in unison;

a valve block means positionable in first and second positions for controlling pressurized fluid to each of said motors, respectively; and said valve block means further positionable in a third position for obtaining pressurized fluid flow simultaneously through both said motors for rotating said ring member at a lower speed and a higher torque than said medium speed/medium torque motors.

8. A power tong as defined in claim 1, further comprising:

a door latch mechanism for latching said door closed to substantially minimize spreading of said first open throat portion and for unlatching said door to open said door.

9. A power tong as defined in claim 1, wherein the diameter of an innermost surface of said ring member approximates the diameter of an innermost surface of said cage plate assembly.

10. A power tong as defined in claim 1, wherein said cage plate assembly is positioned at least partially radially within said ring member and at least partially axially outside said ring member.

11. A power tong for making up and breaking apart tubing, comprising:

a tong body having upper, lower, and intermediate body plates and having a first open throat portion for receiving said tubing;

a ring member including one or more camming surfaces rotatably mounted within said tong body and having a second open throat portion for alignment with said first open throat portion;

a cage plate assembly rotatably mounted at least partially within said ring member and having a third open throat portion for alignment with said first and second open throat portions;

a pair of rotatable drive means for rotating said ring member;

a plurality of heads carried by said cage plate assembly for cooperating with said one or more camming surfaces for gripping engagement with said tubing upon rotation of said ring member relative to said cage plate assembly;

pluralities of upper, lower, and intermediate roller supports carried by said top, bottom, and intermediate plates, respectively, for rotatably guiding said ring member; and said plurality of upper roller supports are in rotatable engagement with said cage plate assembly.

12. A power tong as defined in claim 11, further comprising:

a door pivotable on said tong body for opening to receive said tubing and for closing across said first open throat portion;

said tong body including a drive train body portion spaced substantially opposite said cage plate assembly with respect to said drive gears;

tong securing means attached to said drive train body portion for prohibiting substantial rotation of said tong body; and said first open throat portion having an open throat centerline substantially perpendicular to said tong body centerline.

13. A power tong as defined in claim 11, wherein an outermost surface of said rotatable ring member and cage plate assembly has a diameter of approximately 8.0 inches.

14. A power tong as defined in claim 13, wherein said cage plate assembly includes guide means for limiting movement of said heads in a substantially linear direction; and said guide means controls movement of each of said plurality of heads within said cage plate assembly in a radial direction with respect to the axis of said ring member for gripping engagement with said tubing.

15. A power tong as defined in claim 13, wherein the diameter of an innermost surface of said ring member approximates the diameter of an innermost surface of said cage plate assembly.

16. A power tong as defined in claim 11, further comprising:

said cage plate assembly is of a unitary construction and is rotatably positioned at least partially radially within said ring member and at least partially axially outside said ring member.

17. A power tong as defined in claim 11, further comprising:

each of said plurality of intermediate roller supports is within a plane passing through said plurality of interior cam surfaces and perpendicular to said axis of rotation of said ring member.

18. A method for making up and breaking apart first and second adjacent strings of tubing vertically positioned for a drilling operation with a power tong including a tong body having a first open throat portion for receiving said first and second strings of tubing, a ring member rotatably mounted within said tong body and having a second open throat portion for alignment with said first open throat portion, and a cage plate assembly rotatably mounted within said tong body and having a third open throat portion for alignment with said first and second open throat portions, the method comprising:

positioning said ring member of said power tong in axial alignment with said first string of tubing for making up said first string of tubing;

thereafter activating said power tong for making up said first string of tubing;

thereafter positioning said first open throat portion of said tong body about said first string of tubing;

positioning said ring member of said power tong in axial alignment with said second string of tubing for making up said second string of tubing while said first open throat portion of said tong body is positioned about said first string of tubing;

thereafter activating said power tong for making up said second string of tubing while said first string of tubing remains positioned within said open throat portion of said tong body; and thereafter laterally removing said power tong from said first and second strings of tubing.

19. The method as defined in claim 18, further comprising:

closing a door across said first open throat portion while said first string of tubing is positioned within said first open throat portion of said tong body and interiorly of said closed door; and thereafter activating said power tong for making up said second string of tubing while said first string of tubing remains positioned interiorly of said closed door.

20. A method as defined in claim 19, further comprising:

prohibiting said first string of tubing from contacting an outermost surface of said rotatable ring member and cage plate assembly before making up said second string of tubing.

21. A method as defined in claim 19, further comprising:

latching said door closed for minimizing spreading of said first open throat portion.

* * * * *